US008187066B1

(12) United States Patent
Poisson

(10) Patent No.: US 8,187,066 B1
(45) Date of Patent: May 29, 2012

(54) ONLINE GAMING SYSTEM FOR SIMULATING A BASKETBALL GAME

(76) Inventor: Renald Poisson, Houston, TX (US)

( * ) Notice: Subject to any disclaimer, the term of this patent is extended or adjusted under 35 U.S.C. 154(b) by 408 days.

(21) Appl. No.: 12/427,062

(22) Filed: Apr. 21, 2009

Related U.S. Application Data

(60) Provisional application No. 61/046,862, filed on Apr. 22, 2008.

(51) Int. Cl.
*A63F 9/24* (2006.01)

(52) U.S. Cl. ..... 463/4; 463/11

(58) Field of Classification Search ..... 463/4, 11, 463/42
See application file for complete search history.

(56) References Cited

U.S. PATENT DOCUMENTS 5,749,581 A * 5/1998 Poisson ..... 273/244
5,772,512 A 6/1998 Chichester
5,779,549 A 7/1998 Walker et al.
5,906,370 A 5/1999 Poisson
6,135,885 A 10/2000 Lermusiaux
6,758,754 B1 7/2004 Lavanchy et al.
6,923,717 B2 * 8/2005 Mayer et al. ..... 463/4
2006/0240894 A1 * 10/2006 Andrews ..... 463/42
2006/0252530 A1 11/2006 Oberberger et al.

* cited by examiner

*Primary Examiner* — Brook Kebede
(74) *Attorney, Agent, or Firm* — Buskop Law Group, PC; Wendy Buskop

(57) ABSTRACT

An online system for simulating a basketball game comprising a server with a processor, a network in communication with the server, at least one client device in communication with the network, wherein the at least one client device has an input device, a display device, and a monetary acceptance feature, and a database in communication with the processor. The database comprises electronic decks of passing, rebound, foul shot, and playing cards, and computer instructions for instructing the processor to permit input of bets, deal cards, designate offense and defense players, permit selection of cards by the players, display cards, determine a game outcome based on the selected cards, and award winnings based on the bet and the game outcome.

19 Claims, 7 Drawing Sheets

ONLINE GAMING SYSTEM FOR SIMULATING A BASKETBALL GAME

CROSS REFERENCE TO RELATED APPLICATIONS

This application claims priority to co-pending U.S. Provisional Application Ser. No. 61/046,862 filed on Apr. 22, 2008, entitled: "Online Gaming System for Simulating a Basketball Game". This reference is hereby incorporated in its entirety herein.

FIELD

The present embodiments generally relate to an online gaming system for simulating a basketball game. The simulated basketball game closely follows how professional basketball games are played and includes a monetary acceptance feature for placing bets based on game outcome.

BACKGROUND

A need exists for an online gaming system that simulates a game of basketball, and that closely follows the manner in which professional basketball games are played, while enabling users to experience the simulated basketball game from a home computer, a public computer, or a gaming machine.

A further need exists for an online gaming system that provides a simulated game of basketball that uses cards, thereby incorporating card game elements and strategies, such as bluffing, learning playing strategies of opponents, reading opponents to determine bluffs, counting cards, and the confrontation and competitive aspects of popular card games.

A need also exists for an online gaming system for providing a simulated game of basketball that allows users to place bets and receive winnings based on odds and game outcomes, in the style of popular slot and video card machines.

The present embodiments meet these needs.

BRIEF DESCRIPTION OF THE DRAWINGS

The detailed description will be better understood in conjunction with the accompanying drawings as follows.

Figure 1:
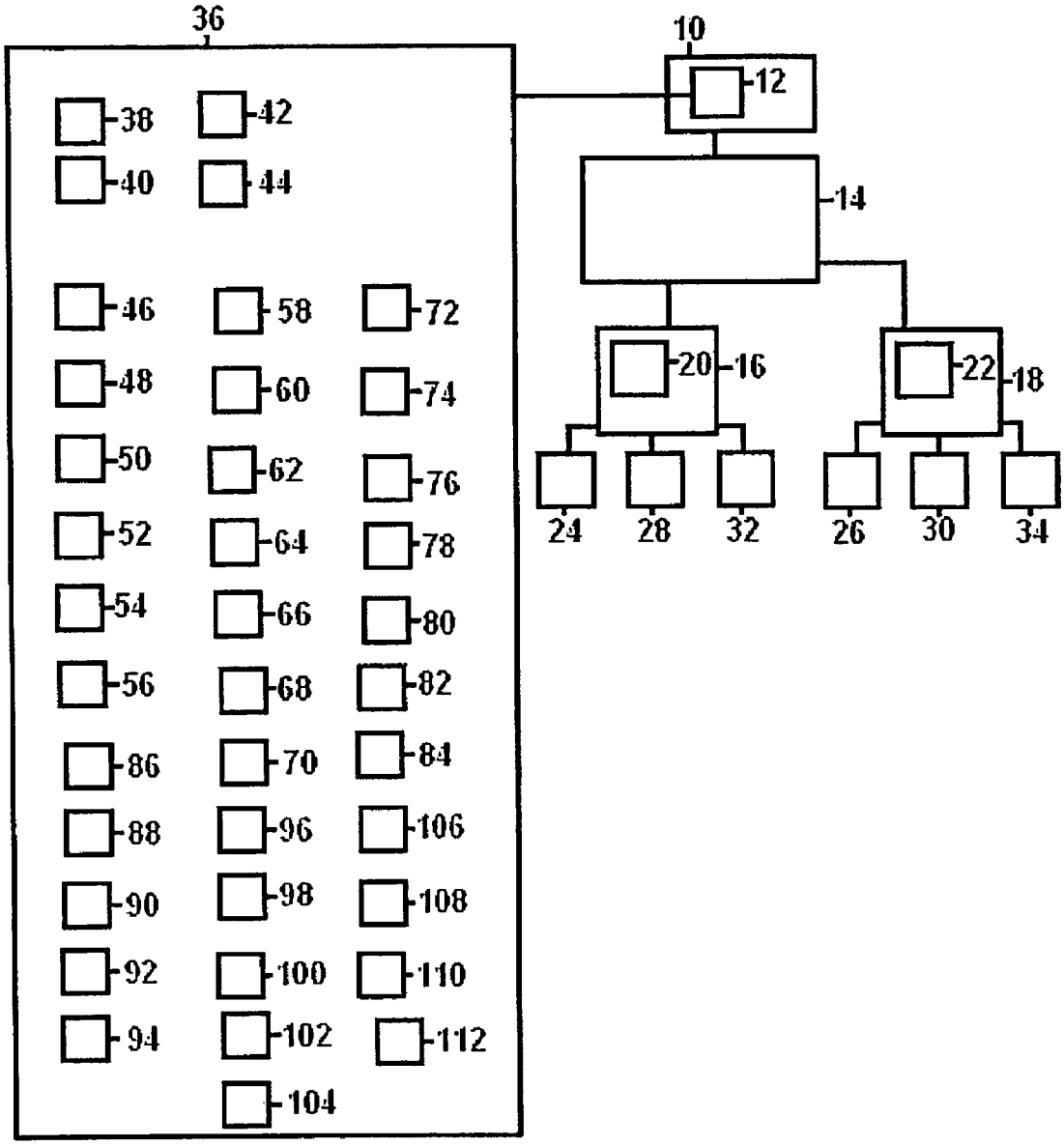
FIG. 1 depicts a schematic drawing of the components of an embodiment of the present system.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an online gaming system for simulating a basketball game that combines game-play and finesse elements relating to popular card games with odds and gambling elements found in slot and video card games.

The present system provides the benefit of enabling one or more users to participate in a simulated basketball game that closely follows the manner in which professional basketball games are played. Offensive cards representing types of passes, shots, and rebounds can be played to represent actions taken by a simulated basketball team in possession of a simulated game ball. Defensive cards representing actions of a simulated defending basketball team, such as fouls, steals, blocked or missed shots, and other types of defensive actions can be played in response to the offensive cards that are played.

Through use of a database, which can be in communication with a network-accessible server, the present system can be accessed directly or remotely by any number of users, individually or simultaneously, for supporting both competitive play between human opponents and play against a simulated player controlled by the server processor.

The present system can enable users to enjoy a simulated game of basketball that incorporates both card game and gambling elements and strategies, from the comfort of a home computer, or using publicly accessible machines in arcades, casinos, and other similar locations.

The present system is advantageously easy to utilize and can permit use of any type and any number of input devices, including a keyboard, a mouse, a touch screen, or other similar input devices. Through use of computer instructions, the present system automatically randomizes and deals cards, and a user need only select visible cards depicted on a display device to cause the simulated basketball game to progress. The present system automatically deals replacement cards, as necessary, and performs all necessary processes and calculations to determine a game outcome based on the selected cards.

The present system can provide education relating to the sport of basketball to players and onlookers in a fun and entertaining manner, using the strategic and finesse-based elements of card gaming.

The present system can include a server having a processor, which can be an Intel™ processor, an AMD™ processor, or another similar type of processor able to execute computer instructions.

One or more networks can be in communication with the server. Useable networks can include the internet, an intranet, a local area network, a wide area network, a virtual private network, a satellite network, a cellular network, other similar networks, and combinations thereof.

At least one client device can communicate with the processor through at least one user interface, which can be in communication with the network. Each client device can be contemplated to include one or more input devices, display devices, and a monetary acceptance feature.

Client devices can include computers, dumb terminals and/or gaming machines in communication with the network, or other devices able to accept input, display output, and communicate with a network, such as a personal digital assistant, a cellular telephone, and similar devices.

It can be contemplated that useable input devices can include a keyboard, a mouse, a keypad, a touch screen, a microphone or speaker and speech-to-text software, and other similar devices.

Monetary acceptance features can include means for accepting credit cards and debit cards, such as card readers, means for accepting currency, such as bill and coin insertion slots, means for accepting facility-specific credits, such as readers for cards issued by casinos, or combinations thereof. It can also be contemplated that one or more input devices can also function as a monetary acceptance feature. For example, a computer keyboard or a keypad on a cellular telephone can be used to input a credit card or debit card number and other information necessary to process charges. A mouse or touch screen can also be used to select numbers to input credit card or debit card information.

The present system can also include a database in communication with the processor.

The database can include an electronic deck of passing cards, an electronic deck of rebound cards, an electronic deck of foul shot cards, and an electronic deck of playing cards.

The electronic deck of passing cards can include a plurality of pass cards, each having a type of pass indicated thereon, with an instruction indicating advancement of a simulated basketball offense player. Pass cards can include bounce pass, chest pass, cross court pass, full court pass, behind the back pass, alley oop pass.

The electronic deck of rebound cards can include a plurality of rebound cards, which can include offensive rebound cards and defensive rebound cards.

The electronic deck of foul shot cards can include a plurality of foul shooting cards, which can include foul shot good and foul shot no good cards.

The electronic deck of playing cards can be contemplated to include a plurality of situation play cards, a plurality of offense cards, and a plurality of defense cards.

Situation play cards can have an instruction thereon concerning a simulated movement, action, or shot, and can include steal, block shot, jump ball, traveling, non-shooting foul, shooting foul, technical foul, and illegal defense.

Each situation play card can include special rules or instructions. For example, a block shot card can have instructions indicating that it is useable to block any shot except a three point shot, while another block shot card can be useable to block any shot except a 20 foot jump shot, and a third can be useable to block any shot except a fifteen foot jump shot. A technical foul card can be played responsive to any shot, but require that a foul shot card be dealt to the basketball offense player, and that the basketball offense player retain possession of the simulated game ball. An illegal defense card can be played in response to any shot or pass card, but if two illegal defense cards are played during a game, a technical foul and resulting foul shot can result.

Offense cards can have a type of shot indicated thereon, which can include lay up, slam dunk, jump hook, sky hook, 10 foot jump shot, 15 foot jump shot, 20 foot jump shot, or 3 point shot.

Defense cards can have a type of shot indicated thereon which can correspond to types of shots indicated on offense cards, for indicating shots that are no good. Defense cards can include lay up no good, slam dunk no good, jump hook no good, sky hook no good, 10 foot jump shot no good, 15 foot jump shot no good, 20 foot jump shot no good, or 3 point shot no good. For example, a "10 foot jump shot no good" card can be played in response to a "10 foot jump shot" card to prevent the basketball offense player from scoring points.

The database can include computer instructions for instructing the processor to electronically randomize the electronic decks of cards. The electronic randomization of the cards can include simulating shuffling of the decks, and storing the shuffled order of the cards in the database. Electronic randomization can also include randomly determining each card dealt at the time it is dealt based on the cards remaining in the electronic decks.

Computer instructions in the database can also instruct the processor permit input of a bet from the input device and the monetary acceptance feature through the user interface and the network to the server. For example, a user can insert a credit card into a credit card reader, then use a keyboard or touch screen to enter and confirm a bet amount.

Bets accepted by the processor can include bets relating to the winner of the game, bets specifying which team will have more points at a certain point in the game, or similar bets relating to the game outcome. Bets can also be placed relating to amounts of points scored by either or both simulated basketball teams, the spread in points between the two simulated teams, or other bets relating to point totals. Bets can also be placed relating to individual plays and/or game outcomes, such as whether the next card played will result in points scored, a blocked shot, a turnover, or any other possible game outcome.

Additional computer instructions can instruct the processor to electronically deal a first plurality of cards from the electronic deck of playing cards and display the first plurality of cards on the display device. It can be contemplated that the first plurality of cards constitutes the user's hand. A user's hand can include any number of cards. For example, a five-card hand, representing the number of players from a single team on a basketball court, can be used when playing a simulated basketball game using a video card machine at a casino, while a larger hand can be used in an internet-based game or a high roller game at a casino.

Computer instructions can also instruct the processor to electronically deal a second plurality of cards from the shuffled deck to a simulated player controlled by the processor. In an embodiment, the second plurality of cards can instead be dealt to a second user playing competitively with a first user.

Computer instructions can then instruct the processor to designate a basketball offense player and a basketball defense player. The designation can be performed randomly. In an embodiment, the computer instructions can permit selection by a user using the input device to indicate whether the user wishes to begin play as the basketball offense player or the basketball defense player.

Additional computer instructions can instruct the processor to electronically deal cards from the electronic deck of passing cards to the basketball offense player.

Computer instructions can then facilitate game play by instructing the processor to permit selection of a pass card by the basketball offense player and display the pass card on the display device. In an embodiment, the pass card can be randomly dealt from the electronic deck of passing cards. The pass card can simulate the type of pass attempted by a basketball team on the offensive.

The computer instructions can then instruct the processor to permit selection of a second card by the basketball defense player, either for discard or responsive to the pass card, and to display the second card on the display. The second card can simulate the action of the defending basketball team in response to the pass card. Even if the second card is discarded, it can be contemplated that computer instructions can instruct the processor to display the second card on the display device, to facilitate counting of cards and tracking of possible future plays.

The computer instructions can further instruct the processor to electronically deal to the basketball offense player a replacement card for the pass card from the electronic deck of passing cards, and to deal to the basketball defense player a replacement card for the second card from the electronic deck of playing cards.

Computer instructions can then instruct the processor to determine a game outcome based on the pass card and the second card, and to award winnings based on the bet and the game outcome.

Game outcomes can include successfully passing the simulated basketball, scoring a predetermined number of points, achieving a certain number of steals, blocks, or turnovers, successfully achieving a certain type of shot, such as a 3 point shot or a slam dunk, achieving or withstanding a predetermined number of fouls, or any other type of possible situation that could occur during the simulated game of basketball. In an embodiment, computer instructions can instruct the processor to play a video, animation, or combinations thereof, that depicts a representation of the game outcome. For example, a video or animation of a basketball player successfully executing an over the head pass over an opposing team member can be played when the basketball offense player and basketball defense player select cards indicating such a result.

It can be contemplated that the second card, played by the basketball defense player, can be a situation play card having an instruction listing a certain type of pass corresponding to the type of pass on the pass card. The instruction can indicate that the game outcome is a turnover, which results in the basketball offense player being designated as the basketball defense player, and the basketball defense player being designated as the basketball offense player. For example, in response to a chest pass selected by the basketball offense player, the basketball defense player can select a card indicating a steal in response to the chest pass, resulting in a turnover.

It can also be contemplated that the second card can be a foul shooting card having instructions indicated thereon. Computer instructions in the database can then instruct the processor to electronically deal and display two foul shot cards from the electronic deck of foul shooting cards, thereby simulating the basketball defense team incurring a foul, and the award of two foul shots to the basketball offense team.

The second card can be a technical foul card having instructions indicated thereon. Computer instructions in the database can then instruct the processor to electronically deal and display one foul shot card from the electronic deck of foul shooting cards, thereby simulating a technical foul and the resulting foul shot.

In an embodiment, the present system can include computer instructions in the database for instructing the processor to display on the display a simulated basketball court. The simulated basketball court can have a first and second basketball goal, a center court area, a first and second paint area, and a plurality of playing positions.

It can be contemplated that each playing position is connected by connecting lines, such that any two playing positions are connected by only a single line. Selected playing positions can include shot positions, each corresponding to a type of shot. The connecting lines can represent passing lanes.

Computer instructions in the database can instruct the processor to display at least one simulated member of a basketball defense team and a simulated game ball, representing the position of a player on a simulated basketball offense team in possession of the simulated game ball, on the simulated basketball court.

Computer instructions can also instruct the processor to display on the display device a tabular means for recording points, fouls, shot attempts, blocks, steals, rebounds, quarters, or combinations thereof. The computer instructions can further instruct the processor to update a position of one or more members of the simulated basketball defense team, a position of the simulated game ball, a number of points, a number of fouls, a number of shot attempts, a number of blocks, a number of steals, a number of rebounds, a quarter, or combinations thereof.

This embodiment can enable the simulated basketball game to be represented not only using cards and/or tabular means, but through graphical means as well.

Computer instructions in the database can instruct the processor to move the simulated game ball a specified number of positions along the passing lanes, to one of the shot positions, in accordance with a set of instructions on a selected pass card, thereby simulating a pass by the basketball offense team.

The computer instructions can then instruct the processor to move one or more simulated members of the basketball defense team along the passing lanes in response to the movement of the simulated game ball, thereby simulating defensive movement of the basketball defense team.

Computer instructions can then instruct the processor to permit selection of a shot card by the basketball offense player. The shot card can be contemplated to have, indicated thereon, a type of shot corresponding to the type of shot represented by the shot position at which the simulated game ball is located.

The computer instructions can instruct the processor to electronically deal a replacement card for the shot card from the electronic deck of playing cards.

Computer instructions can then instruct the processor to permit selection of a discard card by the basketball defense player, and to electronically deal a replacement card for the discard card from the electronic deck of playing cards. The computer instructions can then instruct the processor to award the basketball offense player a number of points indicated on the shot card and to display the number of points.

The basketball offense player can then be designated as the basketball defense player, and the basketball defense player can then be designated as the basketball offense player.

It can also be contemplated that the computer instructions can instruct the processor to permit selection of a defense card by the basketball defense player, the defense card having a type of shot indicated thereon that corresponds to the type of shot on the shot card. For example, the basketball offense player can select a lay-up shot card, corresponding to the shot position at which the simulated game ball is located, and the basketball defense player can select a lay-up no good defense card, thereby preventing the basketball offense player from scoring points.

If a defense card can then be selected and played by the basketball defense player, computer instructions can instruct the processor to permit selection of an offensive rebound card by the basketball offense player, and subsequent selection by the basketball offense player of a shot card with a type of shot corresponding to the shot position.

Computer instructions can also instruct the processor to permit selection of a defensive rebound card by the basketball defense player, which causes the game outcome to be a turnover, the basketball offense player to be designated as the basketball defense player, and the basketball defense player to be designated as the basketball offense player.

In an embodiment, the present system can also include a secondary bonus slot game. Computer instructions in the database can instruct the processor to display the secondary bonus slot game if one or more play achievements occur. Play achievements can include scoring one or more points, or achieving one or more blocks, steals, shots, shot types, fouls, foul shots, or any other possible game outcomes.

The computer instructions can then instruct the processor to permit input of a bonus bet from the input device and the monetary acceptance feature through the user interface and network to the server.

The computer instructions can instruct the processor to electronically spin reels of the secondary bonus slot game and stop the reels, then award bonus winnings based on the bonus bet and the play achievements.

Referring now to FIG. 1, a schematic drawing of an embodiment of the present system is depicted.

FIG. 1 depicts a server (10) having a processor (12). The server (10) can be in communication with a network (14). While FIG. 1 depicts the server (10) in communication with a single network (14), it can be contemplated that the server (10) can be in communication with any type and any number of networks simultaneously.

A first client device (16) and a second client device (18), having a first user interface (20) and a second user interface (22), can be in communication with the network (14). The first client device (16) has a first input device (24) and a first display device (28). The second client device (18) has a second input device (26) and a second display device (30).

While each client device is depicted having a single input device and display device, it can be contemplated that each client device can include any type and number of input and display devices.

The first client device (16) can also include a first monetary acceptance feature (32). The second client device (18) can include a second monetary acceptance feature (34).

A database (36) is shown in communication with the processor (12). The database (36) can be resident in the server (10) and in direct communication with the processor (12). The database (36) can also be remote from the server (10) and in communication with the processor (14) via the network (14).

The database (36) is shown containing an electronic deck of passing cards (38), an electronic deck of rebound cards (40), an electronic deck of foul shot cards (42), and an electronic deck of playing cars (44).

Computer instructions (46) in the database (36) can instruct the processor (12) to electronically randomize the electronic decks of cards.

Computer instructions (48) in the database (36) can instruct the processor (12) to permit input of a bet using one of the input devices (24, 26) and one of the monetary acceptance features (32, 34). It can be contemplated that the bet can be stored in the database (36) until the game outcome is determined and winnings can be awarded.

Computer instructions (50) in the database (36) can instruct the processor (12) to electronically deal a first plurality of cards from the electronic deck of playing cards (44) and to display the first plurality of cards on the display device (28). The first plurality of cards can be contemplated to constitute a user's hand.

Computer instructions (52) in the database (36) can also instruct the processor (12) to electronically deal a second plurality of cards from the electronic deck of playing cards (44) to a second player. The second plurality of cards can constitute the second player's hand. The second player can be a human opponent of the first user, or the second player can be a simulated player controlled by the processor (12). If the second player is a human opponent, the second plurality of cards can be displayed on the display device (30).

Computer instructions (54) in the database (36) can then instruct the processor (12) to designate a basketball offense player and a basketball defense player. The designation of the basketball offense and defense players can be a random designation, such as a simulation of a jump ball, or in an embodiment, a user can be permitted to designate the basketball offense and defense players.

Computer instructions (56) in the database (36) can instruct the processor (12) to electronically deal cards from the electronic deck of passing cards (38) to the basketball offense player.

Computer instructions (58) in the database (36) can instruct the processor (12) to permit selection of a pass card by the basketball defense player and to display the pass card on the display device (28, 30). In an embodiment, the pass card can be randomly dealt from the electronic deck of passing cards (38).

Computer instructions (60) in the database (36) can then instruct the processor (12) to electronically deal a replacement card for the pass card from the electronic deck of passing cards (38).

Computer instructions (62) in the database (36) can then instruct the processor (12) to permit selection of a second card by the basketball defense player responsive to the pass card and to display the second card on the display device (28, 30). The second card can also be discarded, rather than played responsive to the pass card. If discarded, it can be contemplated that the second card can still be displayed on the display device (28, 30), to facilitate card counting and tracking of possible future plays.

Computer instructions (64) in the database (36) can then instruct the processor (12) to electronically deal a replacement card for the second card from the electronic deck of playing cards (44).

Computer instructions (66) in the database (36) can instruct the processor (12) to determine a game outcome based on the pass card and the second card. Computer instructions (68) in the database (36) can also instruct the processor (12) to award winnings based on the bet and the game outcome.

FIG. 1 also depicts computer instructions (70) in the database (36) for instructing the processor (12) to display a simulated basketball field. The simulated basketball court can be contemplated to include two goals, two paint areas, a center court area, a plurality of positions connected by passing lanes which includes multiple shot positions, and a tabular means for recording points, fouls, shot attempts, blocks, steals, rebounds, quarters, other game information, or combinations thereof.

Computer instructions (72) in the database (36) can instruct the processor (12) to display one or more simulated members of the basketball defense team on the simulated basketball court.

Computer instructions (74) in the database (36) can instruct the processor (12) to display a simulated game ball representing the position of a simulated member of the basketball offense team in possession of the ball.

Computer instructions (76) in the database (36) can instruct the processor (12) to also display a tabular means for recording various game information and statistics, such as points, fouls, shot attempts, blocks, steals, rebounds, quarters, or combinations thereof.

Additional computer instructions (78) in the database (36) can instruct the processor (12) to update positions of simulated basketball defense team members, the simulated game ball, a number of points, a number of fouls, a number of shot attempts, a number of blocks, a number of steals, a number of rebounds, a quarter, or combinations thereof.

FIG. 1 also depicts computer instructions (80) in the database (36) for instructing the processor (12) to electronically deal foul shot cards from the electronic deck of foul shot cards (42) responsive to selection by the basketball defense player of cards that are shooting fouls and/or technical fouls. It can be contemplated that the foul shot cards can be randomly dealt from the electronic deck of foul shot cards (42).

Computer instructions (82), shown in the database (36) can instruct the processor (12) to move the simulated game ball a number of positions in adherence with instructions on a selected pass card.

Computer instructions (84) in the database (36) can instruct the processor (12) to move simulated members of the basketball defense team in response to the movement of the simulated game ball.

FIG. 1 further depicts computer instructions (86) in the database (36) for instructing the processor (12) to permit selection of a shot card by the basketball offense player. Computer instructions (88) can instruct the processor (12) to electronically deal a replacement card for the shot card from the electronic deck of playing cards (44).

Computer instructions (90) in the database (36) can instruct the processor (12) to permit the basketball defense player to select a discard card in response to the selected shot card. Computer instructions (92) can instruct the processor (12) to electronically deal a replacement card for the discard card. Computer instructions (94) can then instruct the processor (12) to award the basketball offense player a number of points indicated on the shot card and to display the number of points. Further computer instructions (96) can then instruct the processor (12) to designate the basketball offense player as the basketball defense player and the basketball defense player as the basketball offense player.

Computer instructions (98) in the database (36) can instruct the processor (12) to permit the basketball defense player to select a defense card responsive to the selected shot card. The selected defense card can be contemplated to have thereon a type of shot that corresponds to the type of shot indicated on the selected shot card. Computer instructions (100) can then instruct the processor to electronically deal a replacement card for the defense card. It can be contemplated that following this action, the computer instructions (96) can then instruct the processor (12) to designate the basketball offense player as the basketball defense player and the basketball defense player as the basketball offense player.

FIG. 1 also depicts computer instructions (102) in the database (36) for instructing the processor (12) to permit the basketball defense player to select a defensive rebound card responsive to the defense card. Computer instructions (104) can instruct the processor (12) to permit the basketball offense player to select an offensive rebound card responsive to the defensive card. Computer instructions can also instruct the processor (12) to deal replacement cards for the rebound cards.

FIG. 1 further depicts computer instructions (106) in the database (36) for instructing the processor (12) to display a secondary bonus slot game if one or more play achievements occur. For example, the secondary bonus game could be engaged each time a slam dunk is executed, each time points are scored, each time a foul shot is made, or for any other possible game outcome.

Computer instructions (108) in the database (36) can instruct the processor (12) to permit input of a bonus bet from the input device (24) and the monetary acceptance feature (32) through the user interface (20) and the network (14).

Computer instructions (110) in the database (36) can also instruct the processor (12) to electronically spin and stop reels of the secondary bonus slot game, or otherwise generate a graphical outcome of the secondary bonus slot game.

Computer instructions (112) in the database (36) can then instruct the processor (12) to award bonus winnings based on the bonus bet and one or more play achievements.

Figure 2:
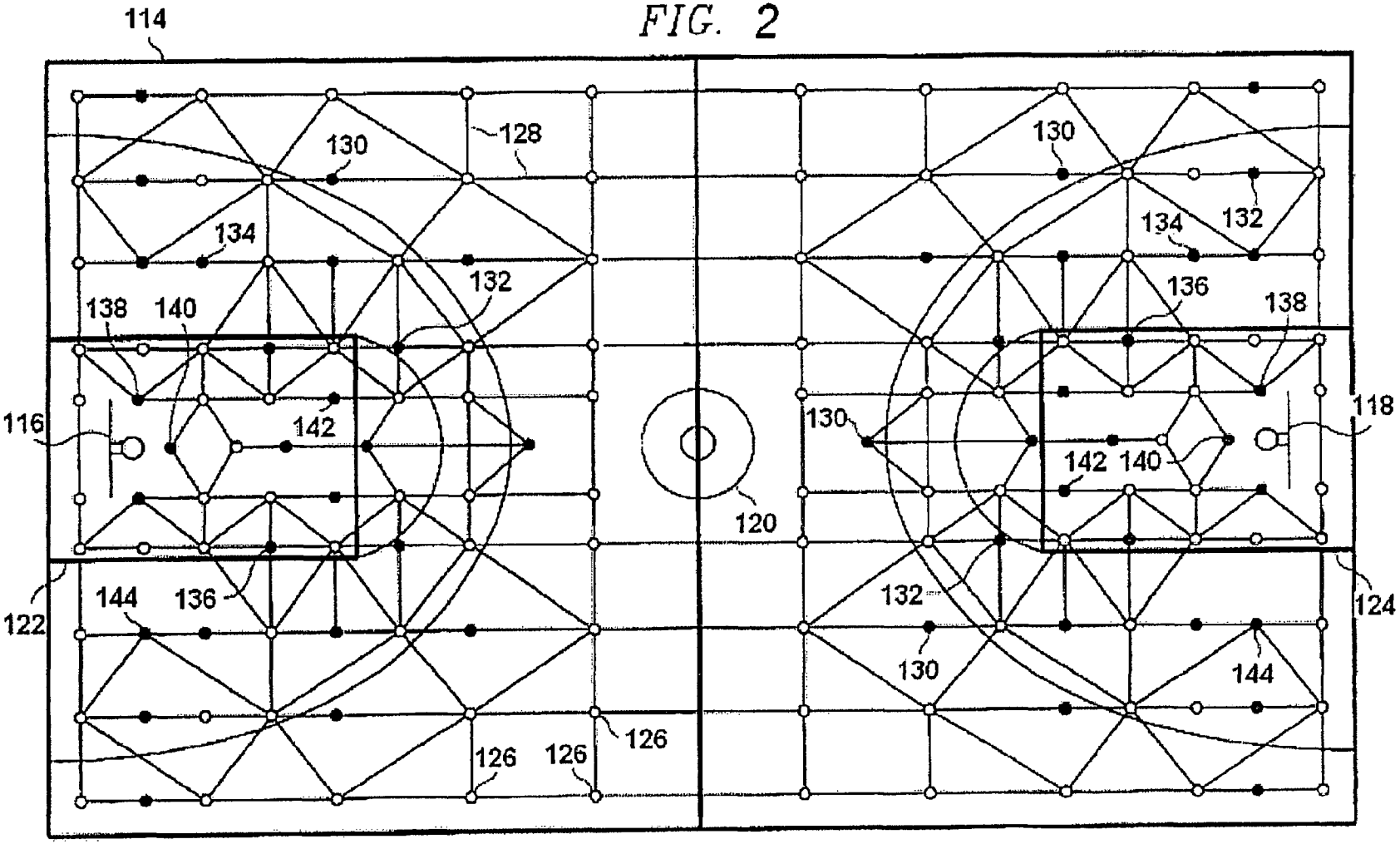
FIG. 2 depicts a display of an embodiment of a simulated basketball court.

FIG. 2 depicts a simulated basketball court (114). The simulated basketball court can have representations of a first basketball goal (116), a second basketball goal (118), a center court position (120), a first paint area (122), a second paint area (124), and a plurality of playing positions (126).

Each of the plurality of playing positions (126) can be connected to other of the playing positions by a plurality of connecting lines (128). Any two playing positions can be connected only by a single connecting line. The connecting lines (128) can represent passing lanes for purposes of directing the simulated game ball and movement of simulated members of the basketball defense teams.

The plurality of playing positions (126) can include a plurality of shot positions. FIG. 2 depicts a 3 point jump shot position (130), a 20 foot jump shot position (132), a 15 foot jump shot position (134), a 10 foot jump shot position (136), a lay up position (138), a slam dunk position (140), a jump hook position (142), and a sky hook position (144). Any number of any of the depicted types of shot positions can be included in the simulated basketball court (114).

FIG. 2 also depicts an area (116) for recording points, fouls, shot attempts, blocks, steals, rebounds, quarters, and other game information and statistics.

Figure 3:
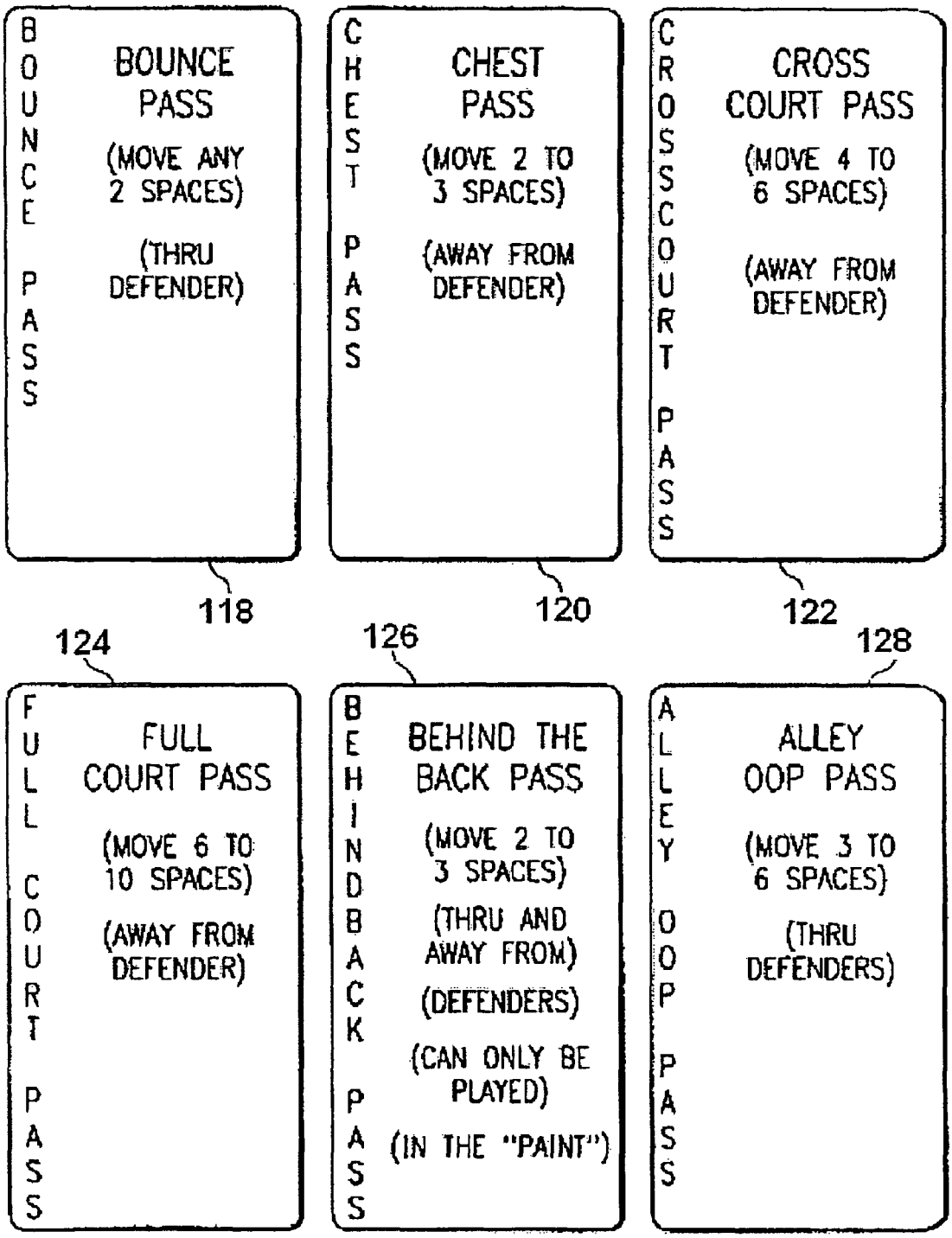
FIG. 3 depicts an embodiment of passing cards.

FIG. 3 depicts an embodiment of passing cards useable with the present system. Each passing card can include a type of pass and instructions regarding the movement of the simulated game ball and/or any conditions that must be present for the card to be played.

FIG. 3 depicts a bounce pass card (118), a chest pass card (120), a cross court pass card (122), a full court pass card (124), a behind the back pass card (126), and an alley oop pass card (128).

Figure 4:
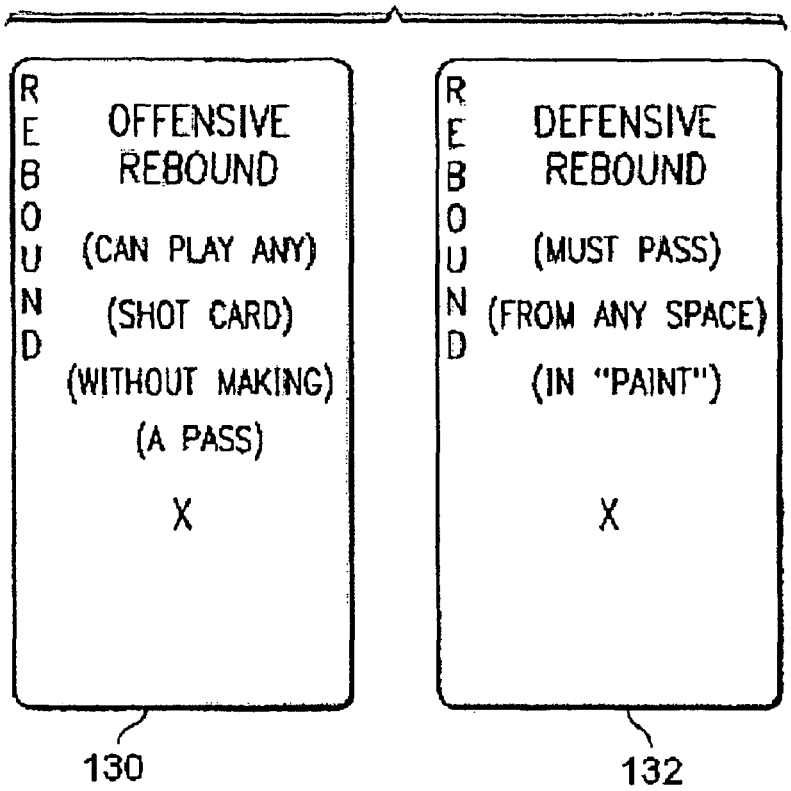
FIG. 4 depicts an embodiment of rebound cards.

FIG. 4 depicts an embodiment of rebound cards useable with the present system. Each rebound card can be an offensive rebound card or a defense rebound card and is contemplated to include instructions relating to movement of the simulated game ball and/or conditions that must be present for the card to be played.

FIG. 4 depicts an offensive rebound card (130) and a defensive rebound card (132).

Figure 5:
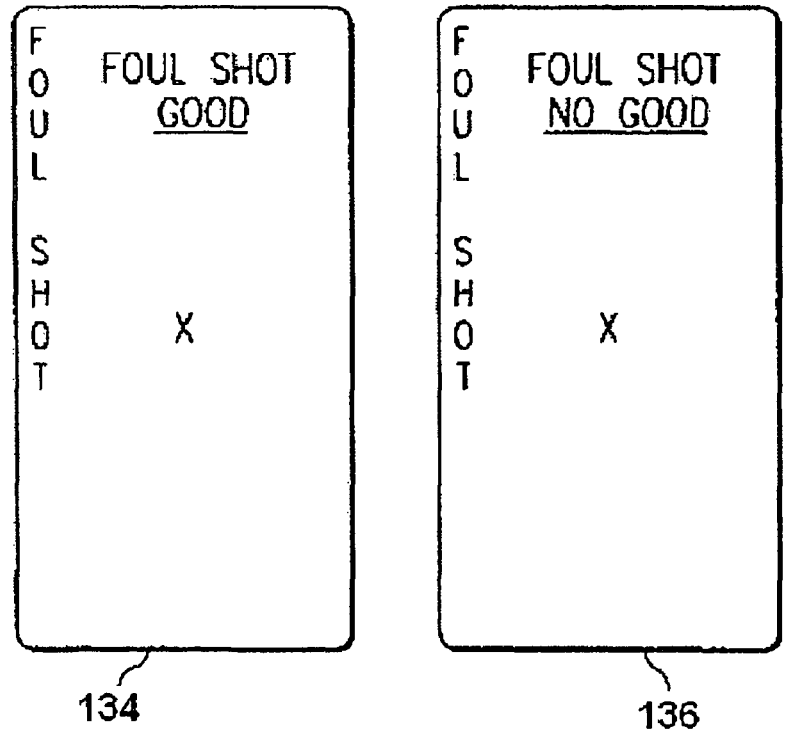
FIG. 5 depicts an embodiment of foul shot cards.

FIG. 5 depicts an embodiment of foul shot cards useable with the present system. Each foul shot card can be contemplated to be electronically dealt at random when instructions on a shooting foul or technical foul card indicate, or when other game conditions indicate that foul shot cards should be dealt. FIG. 5 depicts a foul shot good card (134) and a foul shot no good card (136).

Figure 6:
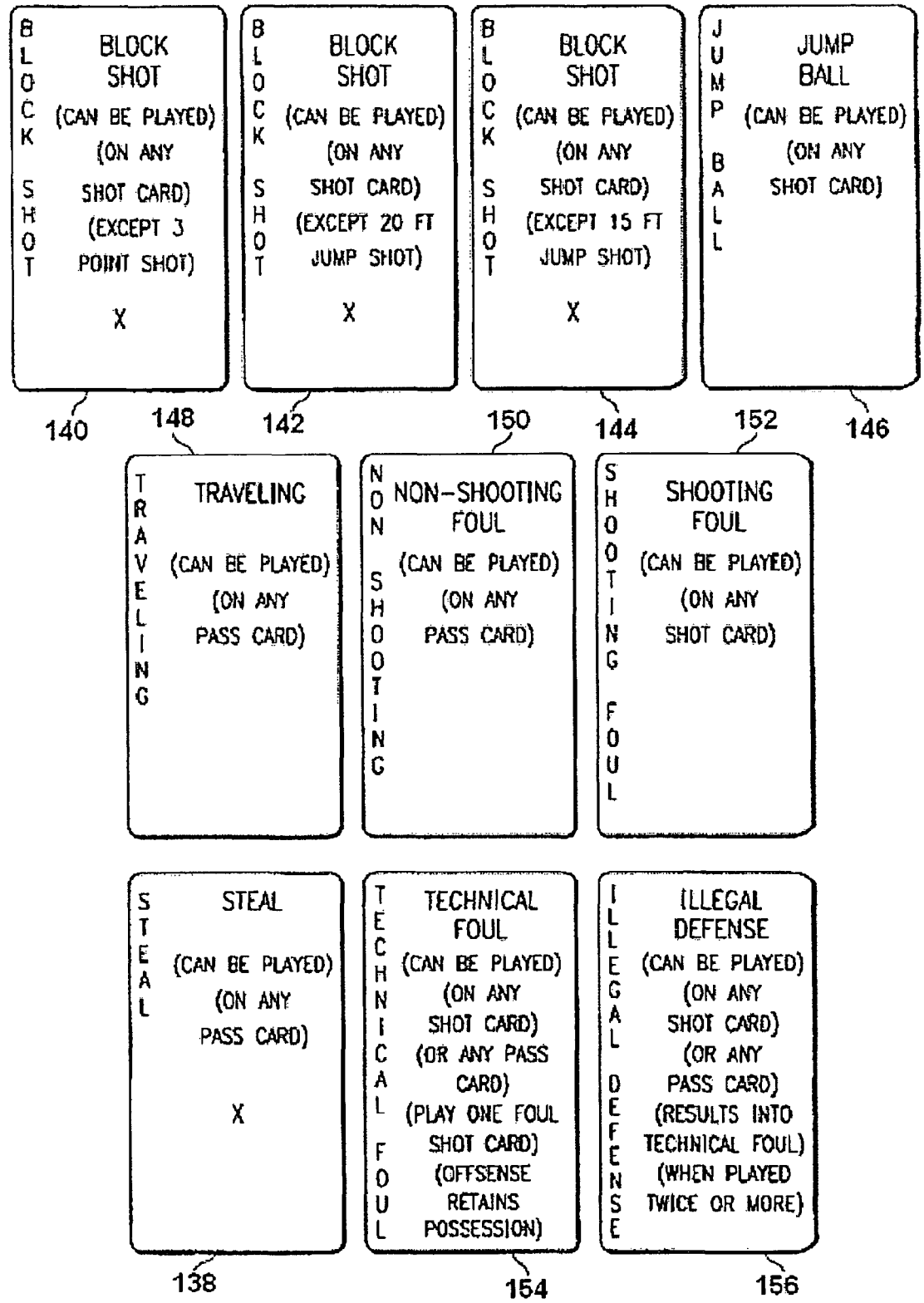
FIG. 6 depicts an embodiment of situation play cards.

FIG. 6 depicts an embodiment of situation play cards useable with the present system. Each situation play card can be contemplated to include the name of a basketball play and instructions relating to movement of the simulated game ball and/or conditions that must be present for the card to be played.

The situation play cards can include a steal card (138), a first block shot card (140), a second block shot card (142), a third block shot card (144), a jump ball card (146), a traveling card (148), a non-shooting foul card (150), a shooting foul card (152), a technical foul card (154), and an illegal defense card (156).

Figure 7:
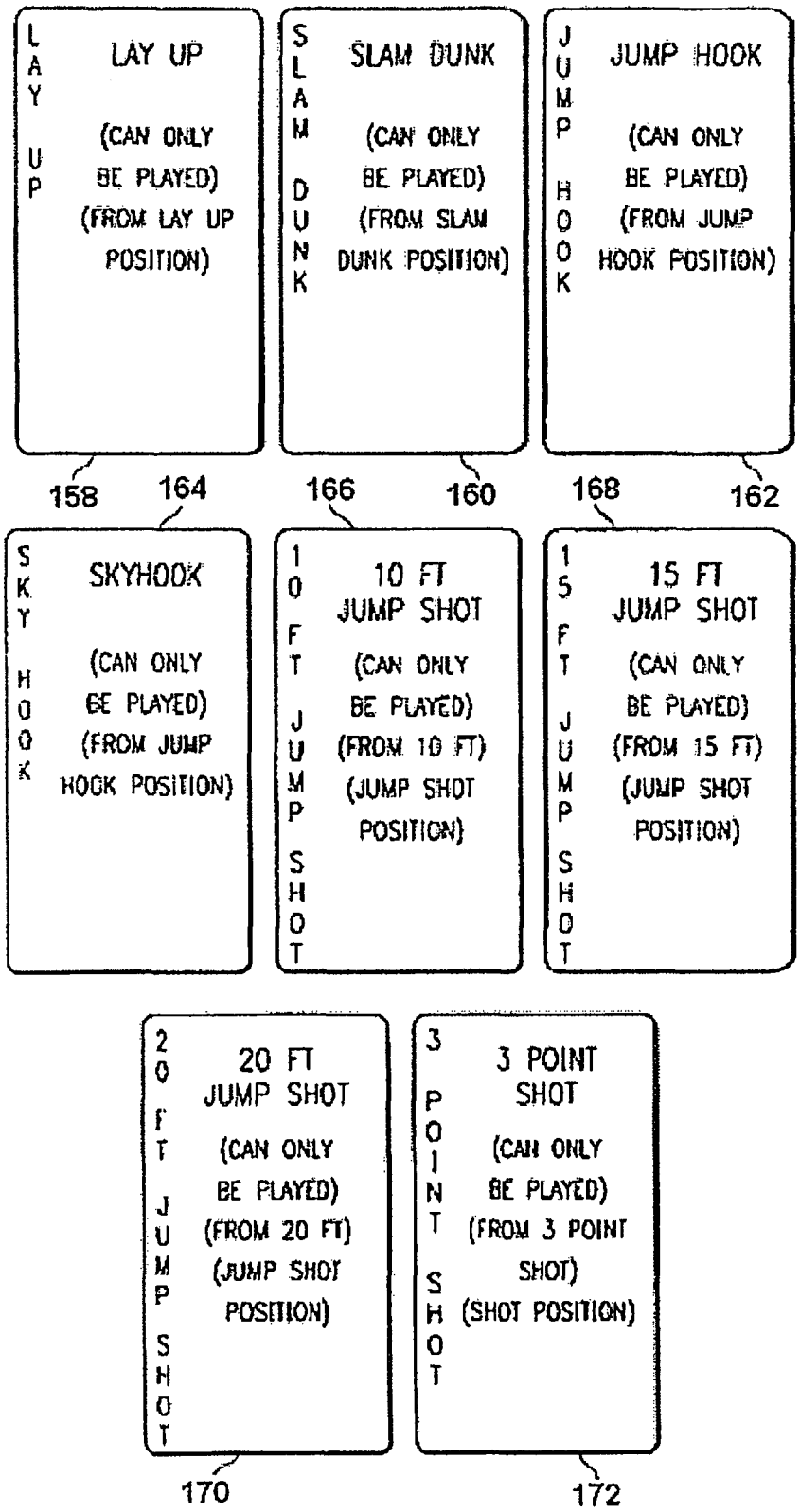
FIG. 7 depicts an embodiment of offense cards.

FIG. 7 depicts an embodiment of offense cards useable with the present system. Each offense card can be contemplated to include a type of shot and instructions relating to conditions that must be present to play the card, points scored for successfully playing the card, and similar information.

FIG. 7 depicts a lay up card (158), a slam dunk card (160), a jump hook card (162), a sky hook card (164), a 10 foot jump shot card (166), a 15 foot jump shot card (168), a 20 foot jump shot card (170), and a 3 point shot card (172).

Figure 8:
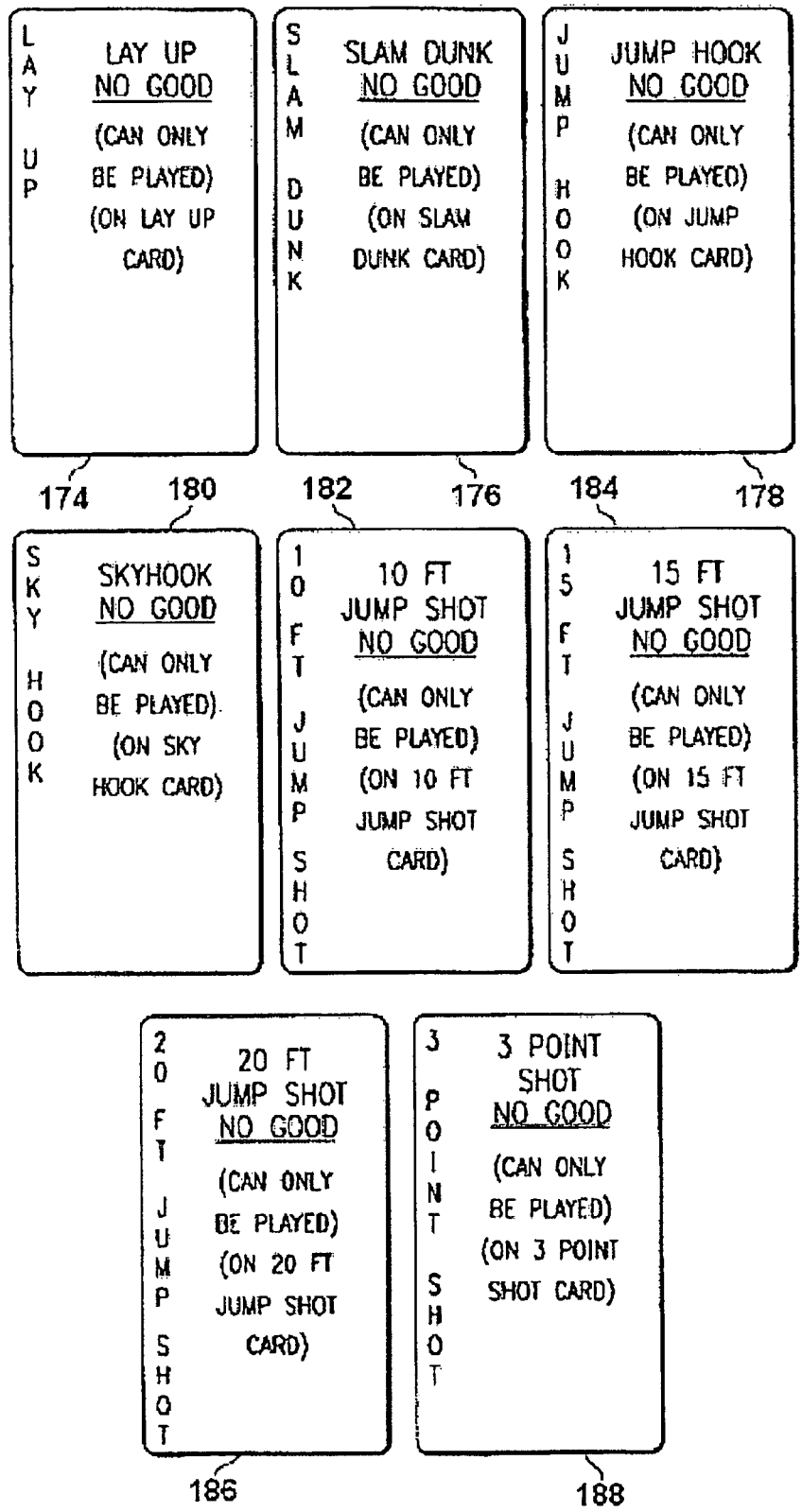
FIG. 8 depicts an embodiment of defense cards.

FIG. 8 depicts an embodiment of defense cards useable with the present system. Each defense card can be contemplated to include a type of shot corresponding to the types of shot listed on the offense cards, and instructions relating to movement of the simulated game ball and/or conditions that must be present for the card to be played.

FIG. 8 depicts a lay up no good card (174), a slam dunk no good card (176), a jump hook no good card (178), a sky hook no good card (180), a 10 foot jump shot no good card (182), a 15 foot jump shot no good card (184), a 20 foot jump shot no good card (186) and a 3 point shot no good card (188).

While these embodiments have been described with emphasis on the embodiments, it should be understood that within the scope of the appended claims, the embodiments might be practiced other than as specifically described herein.

What is claimed is:

1. An online gaming system for simulating a basketball game with gambling elements, the system comprising:

a. a server with a processor;

b. a network in communication with the server;

c. at least one client device with at least one user interface in communication with the network, wherein the at least one client device has an input device, a display device, and a monetary acceptance feature; and d. a database in communication with the processor, the database comprising:

i. an electronic deck of passing cards;

ii. an electronic deck of rebound cards;

iii. an electronic deck of foul shot cards;

iv. an electronic deck of playing cards;

v. computer instructions for instructing the processor to permit input of a bet from the input device and the monetary acceptance feature through the user interface and the network to the server;

vi. computer instructions for instructing the processor to electronically deal a first plurality of cards from the electronic deck of playing cards and display the first plurality of cards on the display device;

vii. computer instructions for instructing the processor to electronically deal a second plurality of cards from the electronic deck of playing cards to a second player;

viii. computer instructions for instructing the processor to designate a basketball offense player and a basketball defense player;

ix. computer instructions for instructing the processor to electronically deal the electronic deck of passing cards to the basketball offense player;

x. computer instructions for instructing the processor to permit selection of a pass card by the basketball offense player and display the pass card on the display device;

xi. computer instructions for instructing the processor to electronically deal to the basketball offense player a replacement card for the pass card from the electronic deck of passing cards;

xii. computer instructions for instructing the processor to permit selection of a second card by the basketball defense player for discard or in response to the pass card;

xiii. computer instructions for instructing the processor to determine a game outcome based on the pass card and the second card;

xiv. computer instructions for awarding winnings based on the bet and the game outcome;

xvii. computer instructions for instructing the processor to display on the display device a secondary bonus slot game if at least one play achievement occurs;

xviii. computer instructions for instructing the processor to permit input of a bonus bet from the input device and the monetary acceptance feature through the user interface and the network to the server;

xix. computer instructions for instructing the processor to electronically spin reels of the secondary bonus slot game and stop the reels; and xx. computer instructions for instructing the processor to award bonus winnings based on the bonus bet and the at least one play achievement.

2. The system of claim 1, wherein the electronic deck of passing cards comprises a plurality of pass cards, each having a type of pass accompanied with an instruction indicating advancement of a simulated basketball offense player:

a. wherein the type of pass is selected from the group consisting of: bounce pass, chest pass, cross court pass, full court pass, behind the back pass, and alley oop pass;

b. wherein the electronic deck of rebound cards comprises a plurality of rebound cards, each having a type of rebound selected from the group consisting of: offensive rebound and defensive rebound;

c. wherein the electronic deck of foul shot cards comprises a plurality of foul shooting cards, each having a type of foul shot selected from the group consisting of: foul shot good and foul shot no good;

d. wherein the electronic deck of playing cards comprises a plurality of situation play cards, a plurality of offense cards, and a plurality of defense cards;

e. wherein each of the plurality of situation play cards has an instruction concerning a simulated movement, action, or shot, and is selected from the group consisting of: steal, block shot, jump ball, traveling, non-shooting foul, shooting foul, technical foul, and illegal defense;

f. wherein each of the plurality of offense cards has a first type of shot selected from the group consisting of: layup, slam dunk, jump hook, sky hook, 10 foot jump shot, 15 foot jump shot, 20 foot jump shot, and 3 point shot; and g. wherein each of the plurality of defense cards has a second type of shot selected from the group consisting of: layup no good, slam dunk no good, jump hook no good, sky hook no good, 10 foot jump shot no good, 15 foot jump shot no good, 20 foot jump shot no good, and 3 point shot no good.

3. The system of claim 1, wherein the database further comprises:

a. computer instructions for instructing the processor to display on the display device a simulated basketball court comprising a first basketball goal, a second basketball goal, a center court position, a first paint area, a second paint area, and a plurality of playing positions, wherein each of the plurality of playing positions is connected to other playing positions by a plurality of connecting lines, wherein any two playing positions are connected only by a single line, wherein the plurality of playing positions include a plurality of shoot positions, and wherein the plurality of connecting lines represent passing lanes;

b. computer instructions for instructing the processor to display on the display device at least one simulated member of a basketball defense team on the simulated basketball court;

c. computer instructions for instructing the processor to display on the display device a simulated game ball;

d. computer instructions for instructing the processor to display on the display device a tabular means for recording points, fouls, shot attempts, blocks, steals, rebounds, quarters, or combinations thereof; and e. computer instructions for instructing the processor to update on the display device a position of the at least one simulated member of the basketball defense team, a position of the simulated game ball, a number of points, a number of fouls, a number of shot attempts, a number of blocks, a number of steals, a number of rebounds, a quarter, or combinations thereof.

4. The system of claim 1, wherein the second card is a situation play card having an instruction listing a certain type of pass corresponding to the type of pass on the pass card, wherein the game outcome is a turnover, and wherein the basketball offense player is designated as the basketball defense player and the basketball defense player is designated as the basketball offense player.

5. The system of claim 1, wherein the second card is a shooting foul card, and wherein the database further comprises computer instructions for instructing the processor to electronically deal and display two foul shot cards from the electronic deck of foul shot cards.

6. The system of claim 1, wherein the second card is a technical foul card, and wherein the database further comprises computer instructions for instructing the processor to electronically deal and display a foul shot card from the electronic deck of foul shot cards.

7. The system of claim 1, wherein the database further comprises:

a. computer instructions for instructing the processor to move the simulated game ball a specified number of positions along the passing lanes to one of the plurality of shot positions in accordance with a set of instructions on the pass card, forming a selected shot position;

b. computer instructions for instructing the processor to move the at least one simulated member of the basketball defense team along the passing lanes in response to the movement of the simulated game ball;

c. computer instructions for instructing the processor to permit selection of a shot card by the basketball offense player, wherein the shot card has a certain type of shot corresponding to a type of shot represented by the selected shot position; and d. computer instructions for instructing the processor to electronically deal a replacement card for the shot card from the electronic deck of playing cards.

8. The system of claim 1, wherein the database further comprises:

a. computer instructions for instructing the processor to permit selection of a discard card by the basketball defense player;

b. computer instructions for instructing the processor to electronically deal a replacement card for the discard card from the electronic deck of playing cards;

c. computer instructions for instructing the processor to award the basketball offense player a number of points indicated on the shot card and display the number of points on the tabular means; and d. computer instructions for designating the basketball offense player as the basketball defense player and designating the basketball defense player as the basketball offense player.

9. The system of claim 1, wherein the database further comprises:

a. computer instructions for instructing the processor to permit selection of a defense card by the basketball defense player, wherein the defense card has a certain type of shot that corresponds to the type of shot on the shot card; and b. computer instructions for instructing the processor to electronically deal a replacement card for the defense card from the electronic deck of playing cards.

10. The system of claim 1, wherein the database further comprises:

a. computer instructions for instructing the processor to permit selection of a rebound card by the basketball defense player, wherein the rebound card is a defensive rebound card; and b. computer instructions for designating the basketball offense player as the basketball defense player and designating the basketball defense player as the basketball offense player.

11. The system of claim 1, wherein the database further comprises:

a. computer instructions for instructing the processor to permit selection of a rebound card by the basketball offense player, wherein the rebound card is an offensive rebound card; and b. computer instructions for instructing the processor to permit selection of a shot card by the basketball offense player, wherein the shot card has a certain type of shot corresponding to a type of shot represented by the selected shot position.

12. The system of claim 1, wherein the monetary acceptance feature is a means for accepting credit cards, a means for accepting debit cards, a means for accepting currency, a means for accepting facility-specific credits, a card reader, a bill and coin insertion slot, a reader for cards issued by casinos, a computer keyboard, a keypad on a cellular telephone, a mouse, a touch screen, or combinations thereof.

13. The system of claim 1, wherein the second player is a simulated player controlled by the processor.

14. The system of claim 1, wherein the computer instructions for instructing the processor to permit input of the bet from the input device and the monetary acceptance feature through the user interface and the network to the server, allowing a user to insert a credit card into a credit card reader and use a keyboard or touch screen to enter and confirm a bet amount.

15. The system of claim 1, wherein the bet is a bet related to a winner of the basketball game, a bet specifying which team will have more points at a certain point in the basketball game, a bet related to the game outcome, a bet related to amounts of points scored, a bet related to a spread in points, a bet related to point totals, or a bet related to individual plays, and wherein the bet is stored in the database until the game outcome is determined and the winnings are awarded.

16. The system of claim 1, wherein the game outcome comprises: successfully passing a simulated basketball, scoring a predetermined number of points, achieving a certain number of steals, achieving a certain number of blocks, achieving a certain number of turnovers, successfully achieving a certain type of shot, or achieving or withstanding a predetermined number of fouls.

17. The system of claim 1, further comprising computer instructions in the database to instruct the processor to play a video, an animation, or combinations thereof that depicts a representation of the game outcome.

18. The system of claim 1, wherein the at least one play achievement comprises: scoring one or more points, achieving one or more blocks, achieving one or more steals, achieving one or more shots, achieving one or more shot types, achieving one or more fouls, or achieving one or more foul shots.

19. The system of claim 1, wherein the secondary bonus game is engaged each time a slam dunk is executed, each time points are scored, or each time a foul shot is made.

* * * * *